United States Patent [19]

Klebe, Jr.

[11] 4,066,111

[45] Jan. 3, 1978

[54] CUTTER HEAD ASSEMBLY FOR POWER PLANERS

[75] Inventor: Elmer C. Klebe, Jr., Easley, S.C.

[73] Assignee: The Singer Company, New York, N.Y.

[21] Appl. No.: 731,286

[22] Filed: Oct. 12, 1976

[51] Int. Cl.[2] ..... B27C 1/10

[52] U.S. Cl. ..... 145/4; 144/225

[58] Field of Search ..... 145/4, 4.1, 4.2; 144/225, 228, 230, 229, 218

[56] References Cited

U.S. PATENT DOCUMENTS

| | | | |
|---|---|---|---|
| Re. 5,535 | 8/1873 | Smith | 144/225 |
| 353,509 | 11/1886 | Shimer | 144/225 |
| 1,457,492 | 6/1923 | Bloodgood | 145/4 X |
| 2,544,098 | 3/1951 | Libby et al. | 145/4 |
| 3,443,613 | 5/1969 | Roods | 145/4 |
| 3,797,766 | 3/1974 | Hennen | 83/700 X |

FOREIGN PATENT DOCUMENTS

| | | | |
|---|---|---|---|
| 2,141,584 | 3/1973 | Germany | 145/4 |
| 618,648 | 2/1949 | United Kingdom | 144/218 |
| 199,324 | 6/1923 | United Kingdom | 144/225 |

*Primary Examiner*—Al Lawrence Smith
*Assistant Examiner*—J. T. Zatarga
*Attorney, Agent, or Firm*—Harold Weinstein; Robert E. Smith; Edward L. Bell

[57] ABSTRACT

A cutter head assembly having two types of independent connecting means to insure that the cutting blade remains mounted to the cutting block even in the unlikely event that one type of connection should fail.

The first type of connecting means are connecting screws which pass through slots in the blade to threadedly engage within tapped holes in the block. The second type of connecting means are security screws affixed to the blades via tapped holes therein to be disposed within apertures of the block so that after the blades are mounted in adjusted position on the set screws threaded into tapped holes which intersect the apertures will engage the security screws affixed to the blade.

6 Claims, 3 Drawing Figures

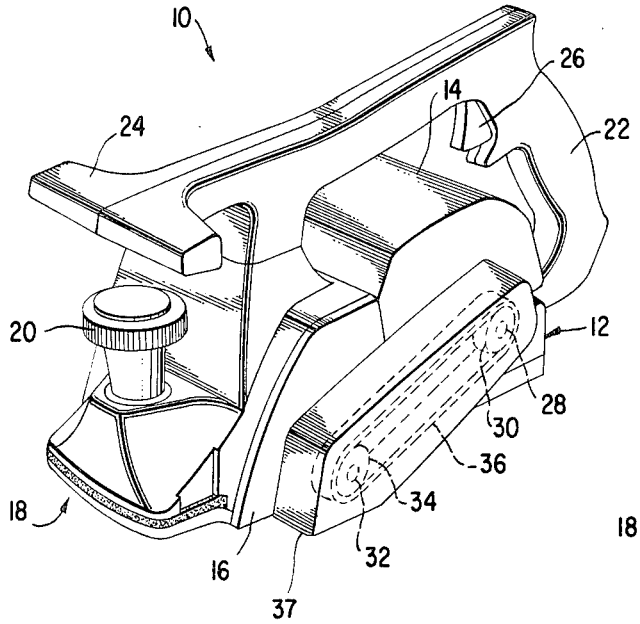
Fig. 1
Fig. 2
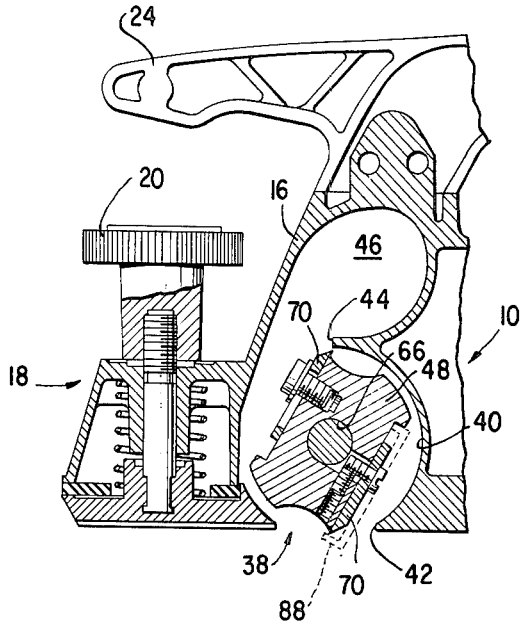
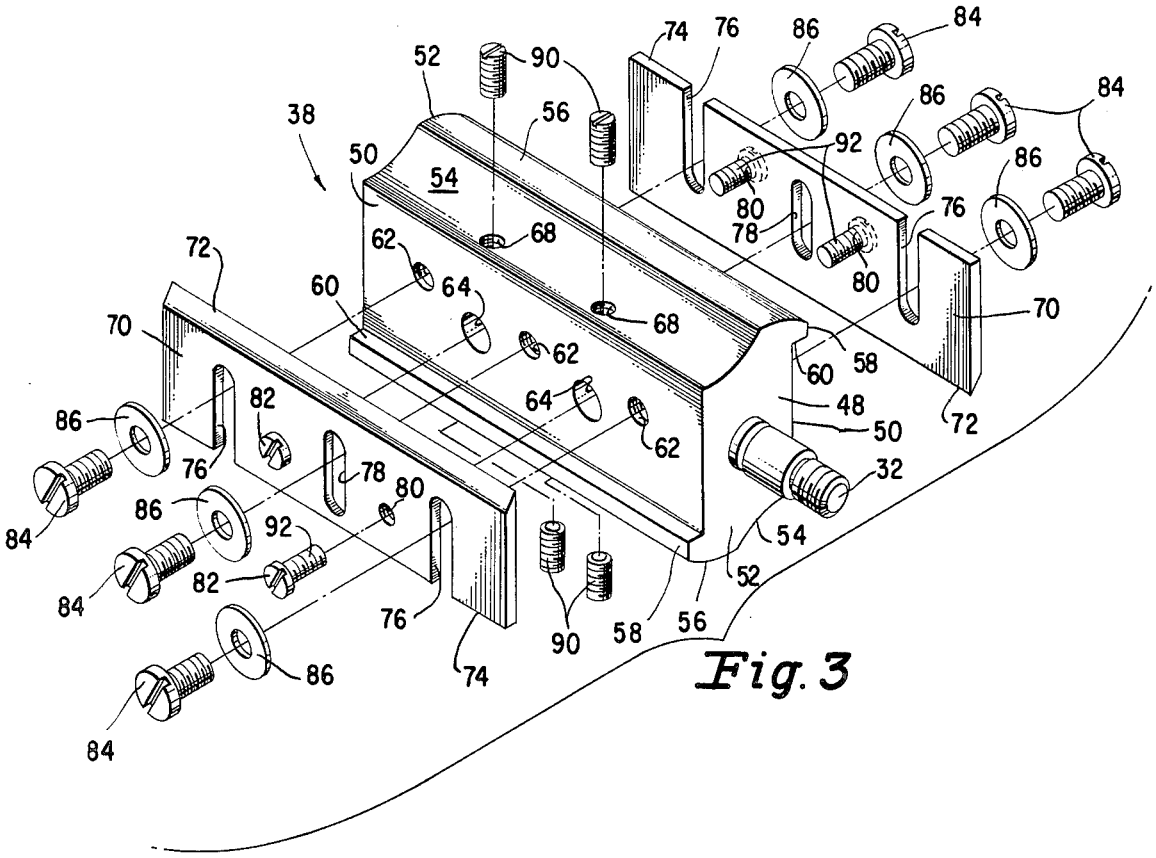
Fig. 3

CUTTER HEAD ASSEMBLY FOR POWER PLANERS

BACKGROUND OF THE INVENTION

Heretofore in the prior arts blades were adjustably secured to the mounting block by a single type of connecting means, usually the connecting screws. If the screw did not pass directly through the blade to clamp the same, then a wedge or other component would clamp the blade to a mounting block.

SUMMARY OF THE INVENTION

It is an object of the present invention to provide an improved cutter head assembly for power planers which overcomes the prior art disadvantages; which is simple, economical and reliable; which has two independent types of connecting means, either one of which is sufficient to secure the cutter blade to the block; which permits detachable connection of the cutter blade to the block; which permits detachable adjustable connections of the cutter blade to the block; which uses two separate and independent means to secure the cutter blade to the block; and which uses one of the threaded means perpendicular to the cutting blade and the other threaded means parallel to the cutting blade to eliminate the possibility of a common failure of the connecting means.

Other objects and advantages will be apparent from the following description of one embodiment of the invention and the novel features will be particularly pointed out hereinafter in the claims.

BRIEF DESCRIPTION OF THE DRAWINGS

This invention is illustrated in the accompanying drawings in which:

FIG. 1 is a perspective illustration of a power planer embodying the present invention.

FIG. 2 is an enlarged partial sectional side elevational view of the front portion of the planer including the novel cutter head assembly of the present invention.

FIG. 3 is an exploded perspective view of the novel cutter head assembly of the present invention.

DESCRIPTION OF THE INVENTION

In the illustrated embodiment of the invention a power planer 10 is shown in FIG. 1 and includes a housing 12 having a motor portion 14 and a cutter portion 16. The forward end of the cutter portion has a depth of cut adjustment assembly 18 wherein rotation of a control knob 20 will set the depth of cut of the planer 10 in a manner well known in the art. The housing includes a main handle 22 disposed rearwardly of the motor portion 14 and auxilary handle 24 disposed forwardly of the cutter portion 16 in superposition to the control knob 20. The operation of the planer 10 is controlled by a trigger switch 26 mounted in the upper interior portion of the main handle 22 and electrically connected to a motor journaled in the motor portion 14, of which only the outer end of the armature shaft 28 is shown in FIG. 1. The shaft 28 has affixed thereto a drive pulley 30. A driven shaft 32 carries a driven pulley 34 which is drivingly connected to the drive pulley 30 by means of a timing belt 36 which will be rotated upon operation of the motor to transmit rotative power to the driven shaft 32. A cover 37 encloses the belt 36 to to prevent accidental contact therewith.

The driven shaft 32 serves to journal the cutter head assembly, designated generally 38, in the forward portion 16 of the housing 12, which assembly 38 is illustrated in FIGS. 2 and 3. The cutter head assembly 38 is disposed in a transverse chamber 40 formed in the cutter portion 16 of the housing 12 with a bottom opening 42 exposing the assembly 38 to the work (not shown), and a top opening 44 through which the work shavings, dust and debris will be discharged through a chute opening 46, illustrated in FIG. 2, the discharge end of which is not shown.

A block 48 is non-rotatively connected to the driven shaft 32 and is disposed in the chamber 40. The block 48 is substantially rectangular in cross-section having opposed long flat sides 50, 50 and shaped shorter opposed sides 52, 52. Each of the sides 52 has a concave portion 54 which starts adjacent one end of the flat side 50 and extends over one-half of the width of the side 52 to run into a higher convex portion 56 which terminates in a ledge 58. The underside of the ledge 58 forms a shoulder 60 which overhangs the end of the flat side 50 opposite the end thereof adjacent the concave portion 54. The flat side 50 has three tapped holes 62 longitudinally spaced from each other and slightly above the center line closer to the end thereof adjacent the concave portion 54. A pair of apertures 64 are formed intermediate the tapped holes 62 to extend into the central bore 66 through which the driven shaft 32 extends. A pair of smaller tapped holes 68 extend downwardly from the concave portion 54 to intersect the apertures 64 as illustrated in FIGS. 2 and 3. The tapped holes 68 are spaced from and substantially parallel to the flat side 50.

A cutter blade 70 is detachably connected to each of the flat sides 50. The cutter blade has a sharpened edge 72 formed at one side thereof and a flat edge 74 on the opposite side so that when connected to the block 48 the sharpened edges 72, 72 are exposed over the end of the side 50 to extend diametrically opposite each other as is shown in FIGS. 2 and 3, while the edges 74, 74 are spaced from the shoulders 60, 60.

The blade 70 has a pair of end slots 76 which are open ended at the flat edge 74, and a closed middle slot 78. A pair of tapped holes 80 are formed between the adjacent slots 76 and 78. The slots 76 and 78 of the blades 70 are formed in alignment with the tapped holes 62 of the block 48, while the tapped holes 80 are formed in alignment with the apertures 64.

A pair of safety screws 82 are threadedly connected in the tapped holes 80 and should remain assembled to the blade 70 whether the blade is changed or adjusted. A slightly larger connecting screw 84 having a flat washer 86 will pass through the slots 76 and 78 to be threadedly received in the tapped holes 62.

The sharpened edge 72 will extend over the end of the flat side 50 by a predetermined amount which as shown in FIG. 2 may be set by a suitable gauge 88 represented by the dotted line recumbent U-shaped member, one edge of which abutts the shoulder 60 while the inner edge of the opposite end is contacted by the sharpened edge 72. Subsequent to the adjustment of the blade 70 the connecting screws 84 are tightened. Also, the adjustment of the blade 70 can take place while the cutter head assembly 38 remains mounted within the cutter head portion 16 of the housing 12. Of course, any blade adustment or changing thereof should be done with the power cord (not shown) disconnected from the power supply.

The slots 76 and 78 permit the blade 70 to be moved relative to the end of the flat side 50 to permit the proper edge 70 exposure. Once the position of the cutter blade is set the connecting screws 84 are tightened whereby the heads thereof and that of the flat washers 86 will bear against the top surface of the blade 70 to clamp the same against the flat side 50 of the block 48.

A second connecting means is provided via the safety screws 82. The tapped holes 80 are formed in alignment with the apertures 64 so that the safety screws 82 which are threadedly received in the tapped holes 80 will extend into the aperture 64 in non-threaded engagement therein. The apertures 64 are sufficiently large to permit adjustment of the cutter blade 70 but are sized to limit such adjustment to within the design parameters of the cutter head assembly 38. With the blade 70 connected to the block 48 via the screws 84, a set screw 90 is threaded into the tapped hole 68 until it contacts and jams against the threaded portion 92 of the safety screw 82 so as to serve as a second, independent connection whereby the cutter blade 70 is prevented from accidently being removed from the block 48.

The threaded connections are made at right angles to each other via the tapped holes 62 and 68 so as to provide an additional safety factor in that one connection tends to act against the other to insure that the cutting blade 70 remains in its assembled position.

It will be understood that various changes in the details, materials, arrangements of parts and operating conditions which have been herein described and illustrated in order to explain the nature of the invention may be made by those skilled in the art within the principles and scope of the invention.

I claim:

1. A cutter blade assembly for a planer powered by an electric motor mounted in a housing comprising:

a. a block journaled in the housing and rotatably connected to the motor, b. a flat side formed on the block, c. a plurality of tapped holes extending inwardly from the flat side of the block, d. a plurality of apertures extending inwardly from the flat side of the block in spaced relation to the tapped holes therein, e. a plurality of tapped holes extending from one of the other sides of the block, one to intersect each of the block apertures, f. a blade disposed on the flat side of the block, g. a plurality of mounting slots formed in the blade, one aligned with each of the block tapped holes of the flat side, h. a plurality of screw connectors, one extending through each of the blade slots to be threadedly received within the block tapped holes and to affix the blade to the block, i. a plurality of tapped holes formed in the blade, one aligned with each of the block apertures, j. the block apertures having a substantially larger cross-sectional area than that of the blade tapped holes, k. a plurality of screw connectors, one to threadedly extend through each of the blade tapped holes and to be disposed within the block apertures a predetermined distance whereby limited adjustment at the blade slots is permitted in connecting the blade to the block, and l. a plurality of set screws, one threadedly connected in each of the tapped holes of said other side of the block and to jam against the threads of the screw connectors disposed within the block apertures to prevent blade removal from the block.

2. The combination claimed in claim 1 wherein:

a. the block apertures are of larger cross-sectional area then either of the plurality of tapped holes of the block.

3. The combination claimed in claim 2 wherein:

a. the block apertures are substantially circular, and b. the block apertures are of smaller diameter than the length of the blade slots.

4. A cutter blade assembly for a planer powered by an electric motor mounted in a housing comprising:

a. a block journaled in the housing and rotatably connected to the motor, b. a pair of diametrically opposed flat sides formed on the block, c. a plurality of tapped holes extending inwardly from each of the flat sides without reaching the opposite flat side, d. a plurality of apertures extending inwardly from each of the flat sides without reaching the opposite flat side, e. a plurality of tapped holes extending from one of the other sides of the block, one intersecting each of the block apertures from each of the flat sides, f. a pair of blades disposed diametrically on the block, one on each of the flat sides thereof, g. each of the blades having a plurality of mounting slots, with the slots aligned to the block tapped holes of the flat sides, h. a plurality of screw connectors, one extending through each of the blades slots to be threadedly received within the block tapped holes to affix the blades to the block, i. each of the blades having a plurality of tapped holes therein formed in alignment with the block apertures of one of the flat sides, j. a plurality of screw connectors, one threadedly received in each of the blade tapped holes and to extend into the aligned block aperture in non-engagement therein whereby limited adjustment at the blade slots is permitted in connecting the blade to the block, and k. a plurality of set screws, one threadedly connected in each of the block tapped holes of the other sides to be jammed into engagement with the screw connectors disposed within the block apertures whereby accidental blade removal from the block is prevented.

5. The combination claimed in claim 4 wherein:

a. each of the flat sides has a rear flange spaced from the blade thereon, b. each of the other sides of the block adjacent the edge of the flat side remote from the flange has a scalloped edge below the blade, and c. each of the tapped holes which intersect the block apertures are formed in the scalloped edges of the other sides.

6. The combination claimed in claim 5 wherein:

a. each of the tapped holes intersecting the apertures are formed perpendicular to said apertures and parallel to one or the other flat sides.

* * * * *